United States Patent [19]

van den Broek

[11] 3,959,830

[45] June 1, 1976

[54] SWIMMING POOL

[75] Inventor: William A. van den Broek, Doylestown, Pa.

[73] Assignee: KDL Sylvan Pools, Inc., Doylestown, Pa.

[22] Filed: Apr. 28, 1975

[21] Appl. No.: 572,578

[52] U.S. Cl. ..... 4/172.19; 4/172.21; 52/288; 52/591; 52/595

[51] Int. Cl.² ..... E04H 3/16; E04H 3/18; F16L 21/02

[58] Field of Search ..... 4/172.19, 172; 52/288, 52/169, 591, 592, 593, 594, 595

[56] References Cited

UNITED STATES PATENTS

| | | | |
|---|---|---|---|
| 3,335,429 | 8/1967 | Arp | 4/172.21 |
| 3,416,165 | 12/1968 | Pereina | 4/172.19 |
| 3,440,780 | 4/1969 | Adam et al. | 52/169 |
| 3,443,263 | 5/1969 | Minasy | 4/172.19 |
| 3,579,665 | 5/1971 | Barker | 4/172.19 |
| 3,634,892 | 1/1972 | Rains | 4/172.21 |
| 3,654,640 | 4/1972 | Katzman | 4/172.19 |
| 3,736,599 | 6/1973 | Kessler et al. | 4/172.19 |
| 3,801,993 | 4/1974 | Stalder | 4/172.19 |

*Primary Examiner*—Henry K. Artis

*Attorney, Agent, or Firm*—Sughrue, Rothwell, Mion, Zinn & Macpeak

[57] ABSTRACT

An in-ground swimming pool of completely plastic construction is comprised of a wall portion having the upper edge thereof substantially at ground level and a flexible plastic liner which is secured to the top of the wall portion and completely covers the interior sides of said wall portion and the bottom portion of the pool. The wall portion is comprised of a plurality of extruded plastic panels interconnected with each other by means of integral tongue and groove members on the panels which are rigidly secured together by solvent bonding of each respective tongue and groove connection. An extruded plastic coping member is provided with an upwardly extending channel in the bottom surface thereof adapted to be force-fitted over the top of the wall portion to secure the vinyl liner therebetween. At least some of said wall panels are provided with externally opening slots adapted to receive extruded plastic support wall panels perpendicular thereto which are provided with tongue means along at least one edge thereof to help stabilize the wall portion. Each wall panel may be formed by two spaced apart walls interconnected by transverse connecting walls or may be comprised of a single wall having tongue and/or groove defining members integrally formed therewith adjacent opposite edges thereof and at at least one location intermediate the ends thereof. The single wall panels may be bent into a curved configuration to provide corner members for a substantially rectangular pool or to provide a generally free form pool. Additional extruded plastic panels having tongue and groove defining members at opposite sides thereof may be interconnected at right angles to each other to provide steps within the pool with the uppermost riser being secured to the underside of the coping by a tongue and groove connection.

19 Claims, 7 Drawing Figures

FIG.3
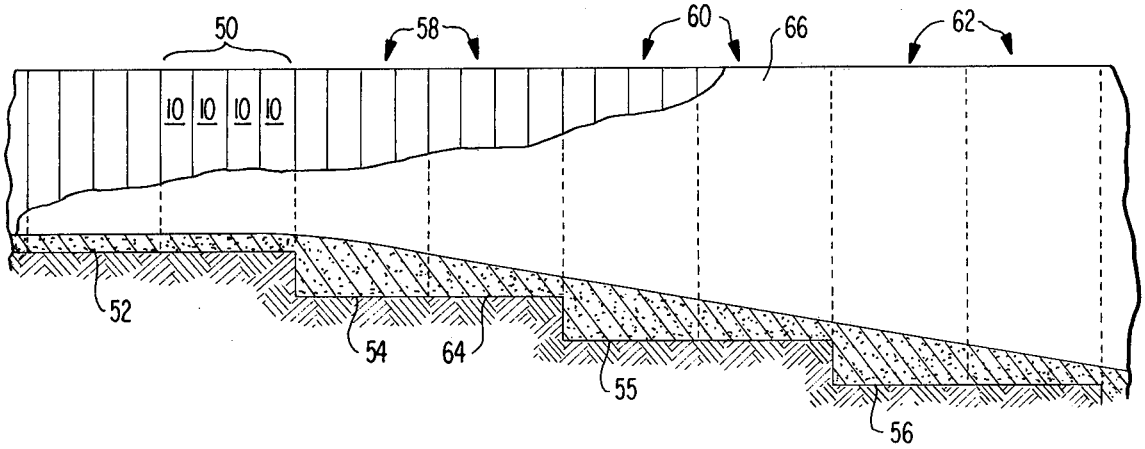
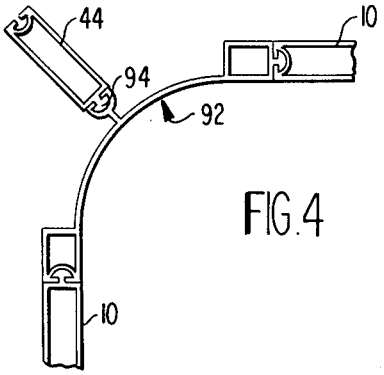
FIG.4
FIG.5
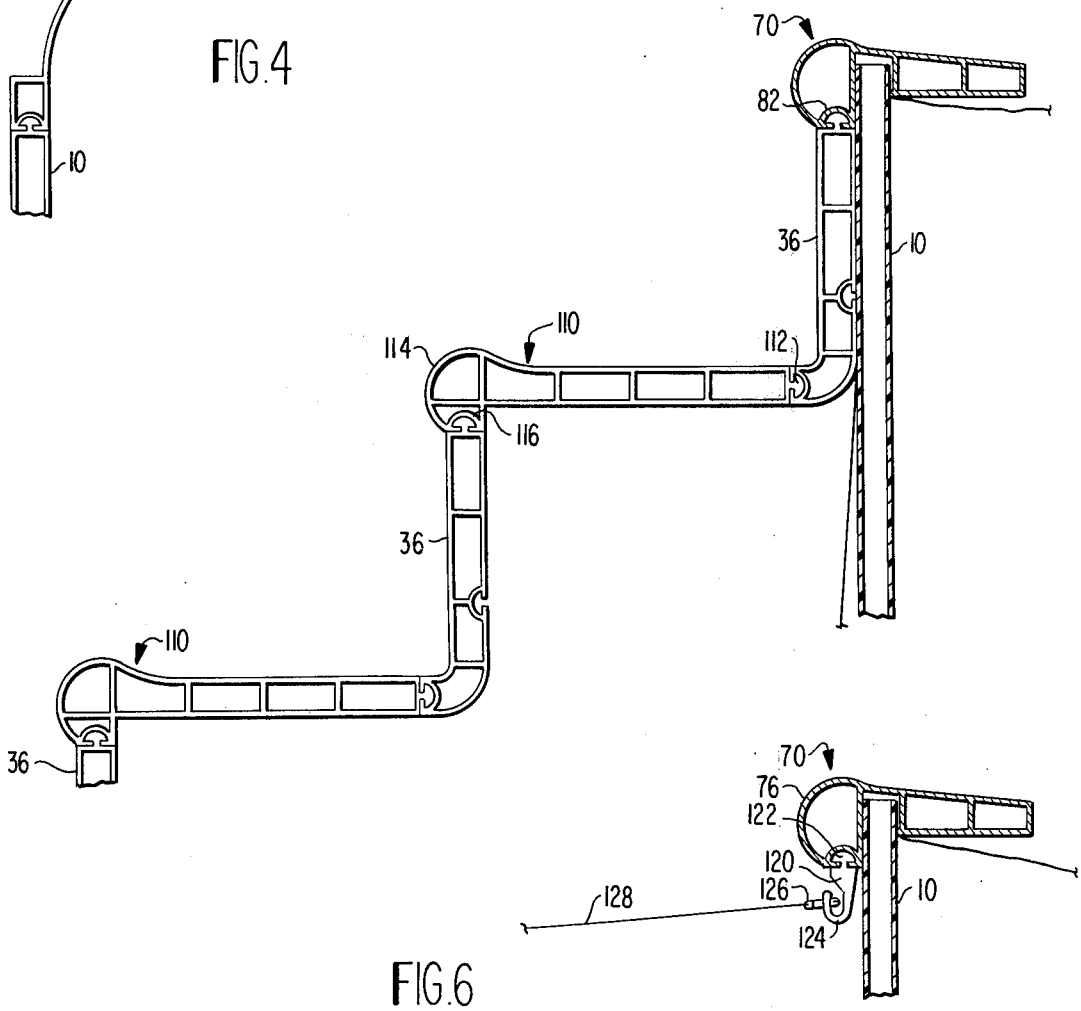
FIG.6

SWIMMING POOL

BACKGROUND OF THE INVENTION

1. Field of the Invention

The present invention is broadly directed to swimming pools of the type having an interior flexible vinyl liner and more specifically to a vinyl liner type pool wherein the supporting wall structure, the coping, the stabilizers, stairs and the like are all of extruded plastic construction.

2. Prior Art

A typical swimming pool construction presently in widespread use includes a plurality of prefabricated panels which are erected upon a ledge formed in the wall of an excavation approximately three feet below the existing grade. The ledge extends around the pool bottom which is provided by shaping the bottom of the excavation to the desired contour to include a deep-end hopper and a shallow-end. The bottom is covered with tamped sand and a flexible plastic liner is positioned thereover with the edge of the liner being gripped between a channel member which extends completely about the top of the panels and a coping mounted on the channel member.

In prior art constructions the practice has been to fabricate the panel sections for the swimming pool wall from wood or metal in large relatively unwieldy sizes. Such sections, typically, might be perhaps three feet high and six to eight feet long and would be framed by heavy lumber, or alternatively by heavy metal flanges. The transportation, handling and installation of such panel sections was always accompanied by considerable difficulty and expense. Furthermore, the leveling of each section was required when the section was placed upon the wall supporting ledge and involved a great deal of care, labor and temporary bracing.

In the evolution of swimming pools of this type the large cumbersome wall panels were eventually replaced by relatively narrow, light, inexpensive extruded aluminum wall panels which were loosely interconnected by tongue and groove connections along the edges of the panels. However, the use of such metallic wall panels which were freely slidable relative to each other required the use of a separate channel member adapted to rest on the ledge extending around the circumference of the pool bottom and a top channel member adapted to fit over the top of the interconnected wall panels to secure the individual panels relative to each other in a stabilized manner. As a result of having to resort to the use of such top and bottom channels the cost of a typical pool installation was substantially increased and considerable design limitations were placed upon the pool construction. The use of such a wall construction for an in-ground vinyl liner type pool further necessitated the use of an extensive ground anchor system for securing the bottom channel members in a stable manner within the excavation and additional earth anchors remote from the pool and connected thereto by horizontally or diagonally extending braces. Finally the use of the bottom channel member necessitated a uniform pool wall height due to the fact that all of the bottom edges of the wall panels had to be supported uniformly in a channel member. As a result the bottom portion of the deep-end of the pool having an optimum slope of approximately 45° left only a relatively small bottom area having the stated maximum depth.

SUMMARY OF THE INVENTION

The present invention provides an in-ground swimming pool of the flexible plastic liner type wherein the entire wall and coping structure as well as other interior and exterior accessories are constructed entirely of plastic material.

The present invention provides an in-ground swimming pool having a wall portion adapted to support a flexible plastic liner wherein the wall portion is comprised entirely of individual extruded plastic wall panel members interconnected by a tongue and groove connection and solvent bonded into a rigid integral structure eliminating the need for top and bottom channel members. The present invention provides an in-ground swimming pool construction wherein the height of the wall portion adapted to support the flexible vinyl liner may be varied throughout the entire circumference of the pool and wherein the configuration of the wall can be readily varied to provide a "free form" pool.

The present invention provides an in-ground swimming pool of the plastic vinyl type having a wall portion comprised of a plurality of extruded plastic segments having tongue and groove connections along opposite edges thereof. Upon interengagement of a respective tongue on one panel with a respective groove on another panel the panels will be laterally stabilized and on introducing a plastic solvent into the tongue and groove connection the adjacent panels can be solvent bonded to provide a vertically stable structure not requiring the use of top and bottom receptor channels. Since the panels are bonded into a stable structure eliminating the need for rigid horizontal bottom channels it is possible to utilize panels having varying vertical dimensions so that the deeper portions of the pool will be provided with a relatively greater bottom area of the maximum stated depth.

The present invention provides an in-ground pool construction of the vinyl liner type having unique wall stabilizing means in the form of extruded plastic panels extending perpendicular to the wall panels and interconnected therewith by means of tongue and groove connections. Adjacent lateral stabilizer panels can further be interconnected by means of an additional extruded plastic panel having tongue and groove means thereon to provide a closed channel-shaped structure on the outside of the pool wall in which additional stabilizing means or water conduit means could be located.

The present invention provides an in-ground swimming pool of the plastic liner type which is comprised completely of solvent bonded, tongue and groove connected plastic panels wherein some of said panels are comprised of a single wall extruded plastic panel having protrusions at opposite ends thereof defining respective tongue and groove means and additional protrusion means intermediate the ends defining tongue or groove connecting means for connection with another panel substantially perpendicular thereto.

The foregoing and other objects, features and advantages of the invention will be apparent from the following more particular description of a preferred embodiment of the invention as illustrated in the accompanying drawings.

IN THE DRAWINGS

FIG. 3 is a side elevation view of a wall segment of a pool according to the present invention with the vinyl liner partly broken away to expose the wall panel arrangement.

FIG. 4 is a top plan view of a modified corner arrangement for a pool using a wall panel similar to the panels as shown in FIG. 2.

FIG. 5 is an end view of a set of steps according to the present invention and connected to a swimming pool shown in section.

FIG. 6 is a partial section view through a coping and wall portion showing an arrangement for supporting a swimming pool cover.

DETAILED DESCRIPTION OF THE INVENTION

The typical in-ground swimming pool of the type having a relatively short upper wall structure and the flexible plastic liner hung therefrom is generally disposed in an excavation having a ledge disposed at a uniform depth below grade and extending completely about the circumference of the pool. The external periphery of the pool is slightly larger than the desired pool periphery depending upon the type of external bracing utilized for the walls of the pool which will rest on the ledge. The ledge is approximately three feet below grade and the wall panels mounted thereon have a height between three and four feet. The bottom of pool at the shallow end thereof will generally be located level with the ledge and will slope downwardly to the deepest portion of the pool.

Figure 1:
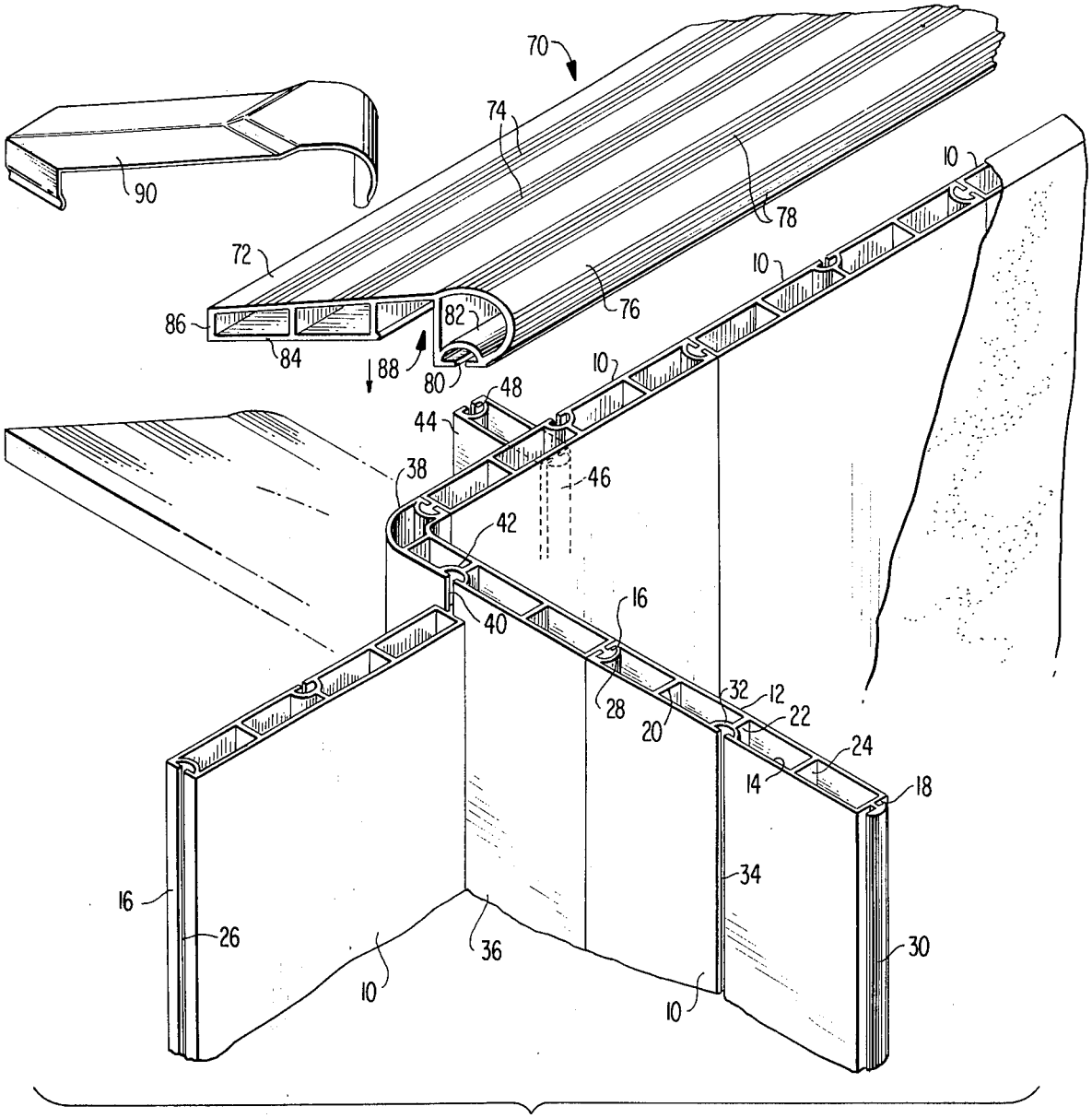
FIG. 1 is an exploded perspective view of the parts, some of which are broken away, which define a corner of a swimming pool according to the present invention.

According to the present invention the width of the ledge can be extremely narrow due to the novel type of wall bracing utilized on the exterior surface of the wall. As best seen in FIG. 1 the pool wall is primarily comprised of a plurality of identical panels 10 each of which consists of an extruded hollow substantially rectangular member having a smooth planar inner wall 12 and a smooth planar outer wall 14 parallel thereto. The inner and outer walls 12 and 14 are connected together by means of integral end walls 16 and 18 which are disposed perpendicular thereto. For the basic wall panel 10 which is nine inches wide the provision of three internal transverse reinforcing walls 20, 22 and 24 has proven to be satisfactory. The end wall 16 is provided with a slot 26 running the entire length thereof which is open to the interior of the wall. An arcuate substantially semi-circular interior wall member 28 is provided which spans the slot 26 to define the groove for the reception of a headed tongue 30 of complementary configuration. The tongue 30 is provided along the entire length of the opposite end 18 of the panel 10. Thus, two adjacent panels 10 can be interconnected by sliding the tongue 30 into the groove 16. The central reinforcing wall 22 is formed with an arcuate, substantially semi-circular wall portion 32 which is connected at its ends to the interior surface of the outer wall 14. A slot 34 extends through the outer wall 14 to define in conjunction with the arcuate wall 32 a groove for the reception of a tongue member which has a complementary configuration such as the tongue member 30.

A corner panel 36 is provided which is substantially identical to the panel 10 but provided with an end portion 38 disposed at right angle to the main portion of the panel. The width of the panel as measured along a median line between the inner and outer walls from end to end would be identical to the width of a standard panel 10 so that the slot 40 and arcuate wall 42 which define the groove would be located 4½ inches from the end having the tongue formed thereon.

Thus, the entire circumference of a rectangular pool can be defined by interconnecting a plurality of wall panels 10 to each other by means of the tongue and groove members with the corners of the pool being defined by the corner panels 36 which are connected to the main wall panels 10 by an identical tongue and groove connection. The panels 10 and 36 are all disposed with the respective slots 34 and 40 facing outwardly of the interior of the pool for the reception of a tongue on the end of any standard member 10 to provide transverse outwardly extending reinforcing panels. It is often not necessary or desirable to use a full width standard panel 10 for the outwardly extending stabilizing member and a narrower stabilizing member 44 having a three-inch width can be utilized. The panel 44 is provided with a tongue 46 on one end thereof identical to the tongue 30 on the standard panel 10 and a groove 48 formed in the opposite end identical to the groove defined by the slot 26 and arcuate wall 28 on the end of the standard panel. Due to the relatively narrow width of the panel 44 it is not necessary to provide any internal transverse reinforcing walls. Thus, in assembling the walls of the pool on the ledge of an excavation a plurality of panels 10 and 36 are interconnected to define a pool of any configuration having right angle corners. The narrow panels 44 can also be used in forming the wall of the pool depending upon the length of the wall section desired. Either the narrow wall panels 44 or the standard panels 10 or a mixture thereof can be connected to the outwardly facing grooves in the wall panels 10 and 36. Such outwardly extending reinforcing panels can be located in every outwardly facing groove or in selected grooves depending upon the bracing requirements for a particular pool installation.

Each and every panel 10, 36 and 44 is extruded from any suitable plastic material such as PVC or the like. A plurality of standard wall panels 10 can be assembled at the factory to form a large panel to reduce the amount of labor necessary at the pool construction site. Such a panel 50 is shown in FIG. 3 and is a composite of four standard panels 10. In assembling the standard panels 10 the tongue and/or groove connection can be coated with a solvent so that upon assembling the panels and allowing the solvent to evaporate the panels 10 will be solvent-bonded to each other. Although the tolerances between the tongue and a respective groove are such to provide a snug fit there is still sufficient clearance so that a solvent could be introduced into the groove after the insertion of a tongue member to solvent bond the panels together upon the evaporation of the solvent. The latter method would be more feasible during the assembling operations at the pool site as will be explained in more detail hereinafter.

As seen in FIG. 3 a plurality of composite panels 50 may be connected together at the pool site to form the wall of the pool. The excavation is formed with a ledge 52 which is generally disposed at a distance three feet below the grade. The ledge 52 can extend about the entire circumference of the pool at the same depth as in previous pool constructions or can be stepped down as indicated by the ledges 54, 55 and 56 as shown in FIG. 3. Each composite panel 50 is connected to the adjacent composite panel by means of the tongue and groove connections and rests directly on the ledge 52. Due to irregularities in the ledge one composite panel 50 might be slightly higher or lower than the adjacent composite panel but this need not be rectified until such time as the entire circumference of the pool wall is assembled by means of the tongue and groove connections. Composite panels 58 can be constructed from individual panels having a four-foot length whereas the panels 10 which make up the composite panel 50 would generally be three feet long. Likewise, the composite panels 60 and 62 could have length of five and six feet, respectively. In this way, it is possible to obtain a greater depth along the edge of the pool at the deep-end of the pool as oppose to the prior art constructions wherein a three-foot wall extended completely about the circumference of the pool with the bottom portion of the pool at the deeper end having a hopper configuration. The fact that the composite panels 50, 58, 60 and 62 rest directly on the dirt ledges 52, 54, 55 and 56, respectively, instead of being disposed in a bottom channel member, facilitates the assembly of panels having a plurality of different lengths. A hopper type bottom can still be provided at the deepest end of the pool but the depth of the pool adjacent the wall at the deep-end can be of much greater depth than with prior art constructions.

After each of the composite panels have been loosely assembled by means of the tongue and groove connections to define a complete circumferential pool wall the composite panels are then secured to each other by means of the solvent bonding technique referred to above. After a first composite panel has been leveled the adjacent composite panel is vertically adjusted so that the top thereof is completely flush with the top of the previously leveled panel. The solvent is then introduced into the tongue and groove connection and the panels are momentarily held in a stable position until the bonding is completed. This operation is repeated for each composite panel about the entire circumference of the pool until the wall of the pool is of unitary solid construction. As each composite panel is leveled with respect to the adjacent panel it might be necessary to raise or lower the ledge to adjust the height of the composite panel. After all of the panels have been bonded to each other the tongue member on the stabilizing panels can be inserted into the grooves formed in the outer surface of the wall as best shown in FIG. 1. The stabilizing panels 10 and/or 44, depending upon the clearance available, will rest on the dirt ledges with the uppermost end thereof being spaced from the top of the wall a sufficient distance to allow for the placing of the coping over the top edge of the pool wall. The excavation for the pool can then be back-filled behind the wall and the bottom of the pool covered with a layer of tampered contoured sand 64 which will extend partly up the wall of the pool to cover the step-effect created by the panels of different lengths. A conventional vinyl liner 66 can then be draped over the walls and bottom of the pool and secured to the top of the wall by means of a coping member.

The coping 70 is best shown in FIG. 1 and is comprised of a top wall 72 having a plurality of ribs 74 formed thereon to provide an anti-skid surface. One edge of the coping 70 is provided with a bullnosed surface 76 also having anti-skid ridges 78 thereon. The bottom surface of the edge 76 is provided with a slot 80 and an internal curved wall 82 behind the slot 80 to define a groove having a configuration complementary to the standard tongue configuration 30 on the other panels. The coping 70 is also provided with a spaced apart bottom surface 84 which is connected to the top wall 72 by means of integral reinforcement walls 86. A channel 88 is defined between the edge 76 and the bottom wall 84 which is adapted to fit over the top of the pool wall to capture and hold the flexible plastic liner which was previously draped over the top of the wall. The dimensions of the channel 88 are such to provide a tight frictional fit without the necessity of additional securing means. The bottom surface 84 of the coping will rest directly on and be supported by the reinforcing or stabilizing members which extend outwardly from the pool wall. At each corner of the pool the end of the coping is cut at a 45° angle, assuming a 90° corner, and the gap between the two copings is covered by means of a corner clip 90 which is constructed of metal or plastic. The clip 90 has a certain degree of flexiblity so that it may be snapped in place over the coping without the necessity of special tools or fastening members.

Figure 2:
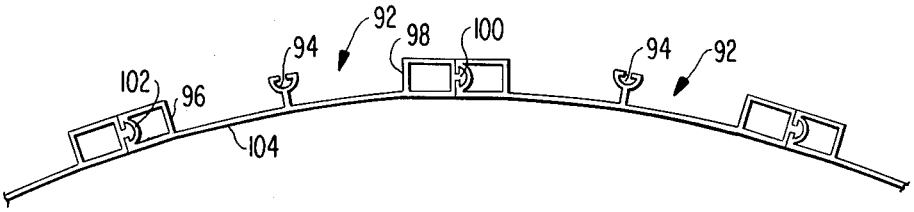
FIG. 2 is a top plan view showing a plurality of modified panels interconnected to define a curved wall section for a swimming pool according to the present invention.

A modified wall panel 92 is shown in FIG. 2 which is also formed as a one-piece plastic extrusion. The modified panel 92 is constructed as a nine-inch width panel similar to the panel 10 but with the wall on one surface being eliminated between the center groove 94 and the transverse reinforcing walls 96 and 98. The walls 96 and 98 are also disposed closer to the tongue and groove structures 100 and 102, respectively, along opposite edges. The panel is therefore provided with only a single smooth wall 104 which will comprise the inner surface of the pool wall. Since only a single wall is provided for each panel 92 the panels are flexible to a certain degree and can be assembled together as shown in FIG. 2 to provide a curved wall structure. By using the 9-inch wide panels 92 it is possible to construct a curved wall having a radius of approximately 17 feet without placing any undue stress on the panel during cold bending of the panel. The single wall panel 92 can also be used to form a corner in a pool having a substantially rectilinear configuration as shown in FIG. 4. Due to the sharper curvature it will be necessary to utilize heat during the bending operation to prevent cracking of the plastic panel. A reinforcing panel 44 can be secured to the center groove 94 in the same manner which the reinforcing panels were connected to the double walled panels. A special coping member could be designed for the corner arrangement as shown in FIG. 4 or the curvature could be much sharper, that is on the order of the curvature shown at the corner in FIG. 1 so that the coping members as illustrated in FIG. 1 could be utilized.

A pool stair arrangement is shown in FIG. 5 which is comprised of a plurality of individual panels which are interconnected at right angles to each other by means of a tongue and groove connection which can be solidified by the solvent bonding technique described above. A plurality of panels identical to the panel 36 shown and described in FIG. 1 are utilized to provide the risers for the stairs with the tongue on the uppermost riser being inserted in the groove formed in the under side of the front edge 76 of the coping member 70. This interconnection would take place preferably prior to the assembly of the coping over the top of the wall but a suitable gap could be provided in the under surface of the coping edge 76 for the subsequent tongue and groove connection of a member 36 to the coping member 70. Each stair tread 110 is comprised of a double walled panel having suitable internal reinforcing walls. A tongue 112 is provided along one edge and the opposite edges with a bullnosed portion 114 having a groove 116 formed in the under surface thereof. The upper surface of the tread member 110 could be provided with anti-skid ridges similar to those provided on the coping member 70. It is also conceivable that the coping member could be provided with a tongue member along the edge opposite to the edge 76 so that the coping member could also be used as a stair tread member. In this way it would be a significant reduction in the number of parts necessary to extrude. Since all of the parts of the stairs are of extruded plastic material the tongue and groove connections would be solvent bonded in the same manner as previously described with respect to other tongue and groove connections. The lowermost riser 36 would rest on the bottom of the pool, preferably at the shallow end. Additional supports could be provided under the stairs to give the stairs added stability and the weight carrying capacity and suitable edge members having integral railings could be provided to frictionally interfit over the end edges of the tread and riser panels.

A pool cover arrangement as shown in FIG. 6 wherein a plurality of individual hanger members 120 can be slidably disposed in the groove formed in the under surface of the edge 76 of the coping member 70. The hanger members 120 can each be provided with a tongue member 122 which could be inserted into the slot 80 of the groove by turning the hanger member at right angles or a separate insertion notch could be provided in the under surface of the coping member 70. Each hanger member is formed with a hook 124 which is adapted to engage in an eye lid 126 secured in the edge of a suitable pool cover 128. It is also contemplated that other accessories could also be readily mounted in the slot formed in the coping member 70 such as protective panels adapted to overly the vinyl liner, lighting fixtures, games fixtures and the like.

Figure 7:
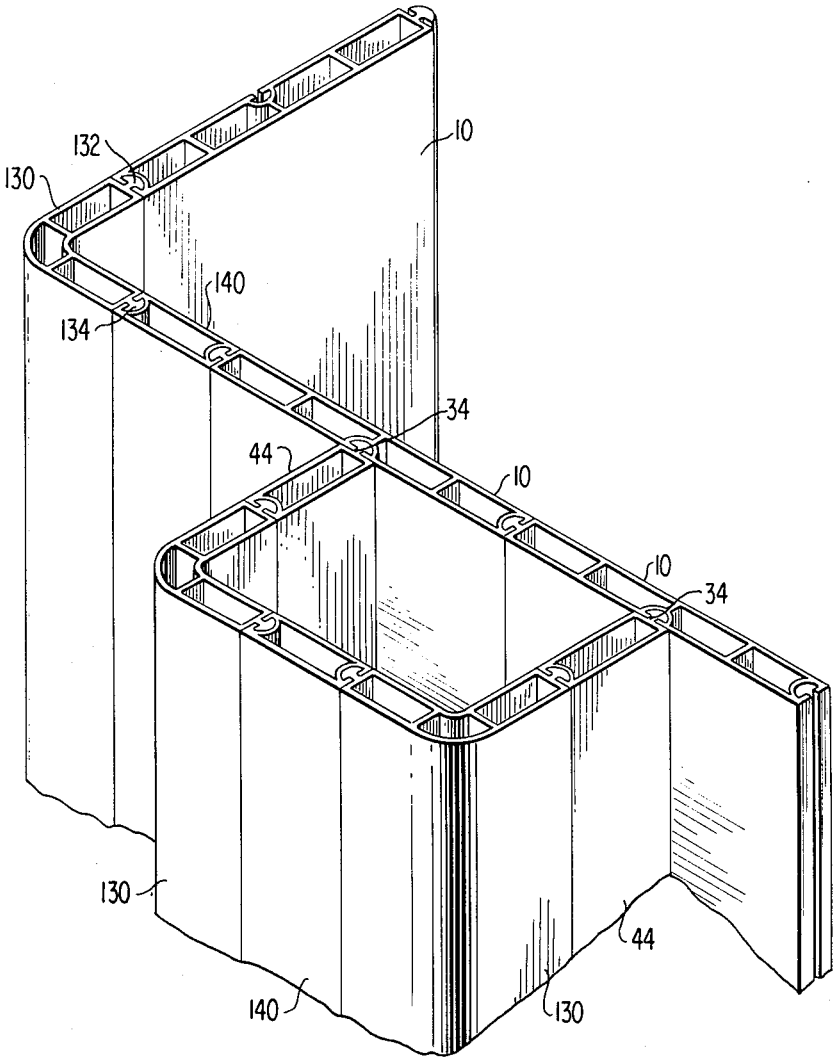
FIG. 7 is a partial perspective view of a modified pool corner and support column arrangement according to the present invention.

A modified pool wall corner and pool wall reinforcing arrangement are shown in FIG. 7 which utilize two entirely different types of panel extrusions. A right angle corner panel which is of extruded plastic construction is provided with tongue members 132 and 134 along opposite edges thereof which are identical to all of the previously described tongue members. Each of the angularly disposed wall portions are of equal width and are preferably three inches wide. An additional plastic panel extrusion 140 is provided which is similar to the three-inch wide panel 44 with the exception that a groove arrangement is provided along each edge of the panel rather than a tongue and a groove.

In assembling these panels 130 and 140 into a pool wall along with standard panels 10 the members 130 are utilized at each corner of the pool. Each wall of pool can be comprised substantially of standard nine-inch panel members 10 but at least one three-inch panel 140 must be provided in each wall of the pool. As in the previous construction shown in FIG. 1 the panels 44 or 10 can be utilized as reinforcing or stabilizing panels disposed at right angles to the walls of the pool. In some areas it might be either desirable or required to provide additional pool reinforcement in the form of a concrete post. By assembling two corner panels 130 at opposite side of a panel 140 a bridging connection can be made between two adjacent stabilizing panels 44 which extend outwardly from two interconnected standard panels 10. This arrangement as shown in FIG. 7 provides a hollow channel having a height equal to the height of the wall at that location which can be filled with concrete to provide the additional reinforcement. It is also contemplated that various pool accessories such as the piping for the skimmers (not shown) or the wiring for the lighting (not shown) could be located within the vertical hollow channel shown in FIG. 7. The elements which make up the channel are all of plastic construction and the various tongue and groove connections would be solvent bonded in the manner previously described.

A channel of larger cross-sectional area could also be provided by using the standard panel 10 instead of the smaller panels 44. It is also contemplated that an extremely large accessory chamber for any desired size could be formed by placing additional panels in each wall of the channel.

While the invention has been particularly shown and described with reference to preferred embodiments thereof it would be understood by those in the art that the foregoing and other changes in form and details may be made therein without departing from the spirit and scope of the invention.

What is claimed is:

1. A swimming pool structure comprising a plurality of interconnected vertically disposed elongated wall panels of plastic material defining the wall portion of said pool, said panels having complementary interlocking tongue and groove connecting means along opposed longitudinal side edges to prevent lateral separation of said panels, said tongue and groove connecting means being additionally solvent bonded to prevent relative longitudinal movement of said panels relative to each other and to permanently join said panels into an integral one-piece wall assembly.

2. A swimming pool structure as set forth in claim 1 further comprising at least one vertically disposed stabilizing panel of plastic material disposed perpendicular to and interconnected with one of said wall panels intermediate the longitudinal side edges of said wall panel, said wall panel and said stabilizing panel being interconnected by tongue and groove connecting means to prevent lateral separation, said tongue and groove connecting means being additionally solvent bonded to prevent longitudinal movement of said panels relative to each other.

3. A swimming pool structure as set forth in claim 2 wherein said stabilizing panel and said one of said wall panels have identical cross-sectional configurations.

4. A swimming pool structure as set forth in claim 1 wherein at least one of said wall panels is comprised of two flat spaced apart parallel surface walls and a plurality of transverse integral side walls and internal reinforcing walls defining a rigid hollow panel, groove means formed in one side wall and in one of said surface walls intermediate the side walls and tongue means formed on the other side wall.

5. A swimming pool structure as set forth in claim 4 wherein said panel is of extruded plastic material.

6. A swimming pool structure as set forth in claim 5 wherein said groove means is provided with an entrance slot narrower than the width of said groove means and said tongue means is provided with a head portion complementary to said groove means and wider than said slot.

7. A swimming pool structure as set forth in claim 1 wherein at least one of said panels is comprised of a flat surface wall and a pair of spaced apart side walls integral therewith and extending from said surface wall perpendicular thereto on the same side, groove means in one of said side walls, complementary tongue means protruding from the other side wall, extension means extending outwardly from said surface wall on the same side as said side walls intermediate said side walls and additional groove means identical to said first mentioned groove means formed in said extension means.

8. A swimming pool structure as set forth in claim 7 wherein said panel is of extruded plastic material.

9. A swimming pool structure as set forth in claim 8 wherein each of said groove means is provided with an entrance slot narrower than the width of said groove means and said tongue means is provided with a head portion complementary to said groove means and wider than said slot.

10. A swimming pool structure as set forth in claim 1 wherein one of said panels is comprised of a smooth curved wall portion having side walls integrally formed therewith at each end thereof, said side walls being disposed perpendicularly to said curved wall portion and being disposed orthogonal relative to each other, one of said side walls having groove means formed therein and tongue means protruding from the other of said side walls.

11. A swimming pool structure as set forth in claim 10 further comprising additional groove means formed on the same side of said curved wall surface as said side wall end disposed intermediate said side walls.

12. A swimming pool structure as set forth in claim 1 wherein said pool has a substantially rectilinear configuration with said wall panels increasing in length from one end of said pool to the other.

13. A swimming pool structure as set forth in claim 1 further comprising a coping member having a substantially flat upper surface merging with a rounded edge portion along one edge thereof and channel means formed on the under side of said flat surface adjacent said rounded portion, said channel having a width substantialy equal to the thickness of said wall panels for receiving the upper ends of said wall panels, said rounded portion having downwardly opening groove means having a configuration identical to the groove means in said wall panels.

14. A swimming pool structure as set forth in claim 13 further comprising stair means comprised of a plurality of tread members and riser members of plastic material, each of said tread members and riser members having tongue means along one edge and groove means along the opposite edge for interconnection with each other, the upper edge of the top riser having tongue means disposed interengage relation with the groove means in said coping member.

15. A swimming pool structure as set forth in claim 13 further comprising a plurality of hook members having tongue means formed thereon and interconnected with said groove means in said coping member for supporting pool accessories such as a cover.

16. A panel for a swimming pool wall adapted to be vertically disposed comprising a flat surface wall having a pair of spaced apart side walls integral with and extending from said surface wall perpendicular thereto on the same side, groove means in one of said side walls, complementary tongue means on the other side wall, extension means extending outwardly from said surface wall on the same side as said side walls intermediate said side walls and additional groove means identical to said first mentioned groove means formed in said extension means.

17. A panel as set forth in claim 16 further comprising a pair of additional coplanar flat walls integrally connected to said side walls and said extension means on opposite sides of said groove means parallel to said first mentioned surface wall.

18. A panel as set forth in claim 17 wherein said panel is of extruded plastic material.

19. A panel as set forth in claim 17 wherein said groove means is provided with an entrance slot narrower than the width of said groove means and said tongue means is provided with the head portion complementary to said groove means and wider than said slot.

* * * * *